137-13 SR

1/12/82 OR 4,310,011

United States Patent [19]

Tackett, Jr.

[11] 4,310,011

[45] Jan. 12, 1982

[54] METHOD FOR MAXIMIZING THE PUMPABILITY EFFICIENCY OF A HYDROCARBON SLURRY BY CONTROLLING THE WAX CRYSTAL CONTENT

[75] Inventor: James E. Tackett, Jr., Littleton, Colo.

[73] Assignee: Marathon Oil Company, Littleton, Colo.

[21] Appl. No.: 139,889

[22] Filed: Apr. 14, 1980

[51] Int. Cl.[3] ..... F17D 1/16

[52] U.S. Cl. ..... 137/13; 208/347

[58] Field of Search ..... 137/13; 208/347, 370, 208/Dig. 1, 93, 37

[56] References Cited

U.S. PATENT DOCUMENTS

| | | | |
|---|---|---|---|
| 3,804,752 | 4/1974 | Merrill et al. | 137/13 X |
| 3,846,279 | 11/1974 | Merrill | 137/13 X |
| 3,910,299 | 10/1975 | Tackett | 137/13 X |

*Primary Examiner*—Alan Cohan

*Attorney, Agent, or Firm*—Jack L. Hummel

[57] ABSTRACT

The efficiency of pumping a hydrocarbon slurry in a pipeline is determined prior to transportation by the relationship:

$$\Delta P = ae^{bX}$$

wherein ΔP is the pressure drop expected to be experienced by the slurry in the pipeline in pounds per square inch (psi), "a" and "b" are constants relating to the size of the pipeline, the flow rate of the slurry and the hydrodynamic volume of the wax crystals, and "X" is the wax crystal content in the slurry from the congealed particles in percentage by weight. The wax crystal content of the slurry is measured, such as by nuclear magnetic resonance and/or differential scanning calorimetry, and is used in conjunction with the constants "a" and "b" to determine the expected pressure drop of the slurry in a particular pipeline. The wax crystal content of the slurry may then be modified, if necessary, to obtain desirable or optimum slurry pumpability conditions for the pipeline.

8 Claims, No Drawings

METHOD FOR MAXIMIZING THE PUMPABILITY EFFICIENCY OF A HYDROCARBON SLURRY BY CONTROLLING THE WAX CRYSTAL CONTENT

BACKGROUND OF THE INVENTION

This invention relates to the preparation, storage and transportation of waxy hydrocarbon mixtures. In this field, a hydrocarbon mixture is distilled to produce an overheads fraction which is used as the carrier fluid for the heavier fractions of the distillation process. The heavier fractions are carried in the overhead in the form of congealed particles having diameters of about 0.05 mm to about 20 mm or more. These particles are formed by such processes as prilling, extruding or beading and the resulting slurry is pumped in a transporting system that includes a pipeline. Upon pumping, these congealed particles partially dissolve with time and mixing to leave isolated wax crystals in the carrier fluid.

In order to maximize the percent of each hydrocarbon mixture that can be processed into a transportable slurry, as much overhead as economically feasible must be distilled. Prior art approaches to obtaining economically pumpable slurries have included methods designed to determine the maximum amount of overhead that can be obtained from the hydrocarbon without creating a slurry which has too large a pressure drop when pumped. Past methods include the cloud point or pour point to determine the distillation cutpoint for the overhead. In the pour point methods, the cutpoint is generally at a fraction whose pour point is about 15° C. to about 122° C. below the average temperature of the transporting system.

Experimental data has shown that the use of the cloud point or pour point to determine the distillation cutpoint is unreliable. In some cases, a low viscosity overhead with a pour point higher than the slurry pumping temperature contributed little to the slurry pressure drop whereas a lower pour point overhead (12.2° C. blow the slurry pumping temperature) contributed significantly to the pressure drop within the pipeline. In particular, methods that use the cloud point or pour point to determine the maximum amount of overhead that can be taken do not consider the effect of wax crystal type on slurry pumpability. Wax crystals formed in the overhead can be substantially different than those formed in the congealed particles of the heavy fractions, and the presence of wax crystals from the overhead greatly increases the slurry pressure drop. After the congealed particles partially disintegrate leaving isolated wax crystals, some wax crystals from the overhead are still detrimental to the slurry pumpability.

Processes such as flash distillation can have a large overlap in the cuts and can result in overheads with a great number of wax crystals. The wax crystals are from fractions that boil within the range of the heavy cuts and crystallize in the overhead at the slurry transporting temperature. Additives do not affect the amount of wax crystals in the overhead but can modify the crystal structure of the wax which crystallizes in the presence of these additives and be beneficial in some, but not all cases. Regardless of the cause, these wax crystals are more economically conveyed in the congealed particles of the heavy fractions than in the overhead and should be minimized in the overhead.

U.S. Pat. No. 4,149,756 teaches a method of optimizing the pumpability of a hydrocarbon slurry by determining the optimum distillation cutpoint of a hydrocarbon mixture as the distillation temperature at which there is a substantial increase in overhead viscosities and/or pressure drop during pipelining of slurries comprising the overhead. The molecular carbon number distribution of the overhead at the optimum distillation cutpoint is determined and compared with the molecular carbon number distribution of the overhead in the distillation process. The distillation process is then adjusted to obtain an overhead fraction having substantially the same molecular carbon number distribution as the overhead taken at the optimum distillation cutpoint.

The present invention may be used in connection with that of U.S. Pat. No. 4,149,756 or may be used independently of that invention. In the method of the present invention, the pumpability efficiency of a hydrocarbon slurry is determined prior to stabilization of the slurry and prior to transporting the slurry through a pipeline by measuring the wax crystal content of the slurry, and then utilizing the known wax crystal content to determine the expected pressure drop that the slurry will experience when transported through a particular pipeline. The wax crystal content of the slurry may then be modified or controlled to obtain desirable or optimum slurry pumpability conditions for the pipeline. The present invention permits the design of a variety of slurry systems, each employing differing waxy hydrocarbon mixtures having a variety of wax crystal characteristics in a particular pipeline prior to actually pumping the slurries in the pipeline and encountering difficulties with slurry pumpability.

PREFERRED EMBODIMENTS OF THE INVENTION

The method of the present invention is particularly useful in connection with waxy hydrocarbon mixtures having average pour points above the seasonably ambient temperature of the transportation system, e.g., a pipeline, and which are capable of being distilled into an overheads fraction and a bottoms fraction with at least a portion of the bottoms fraction being formed into prills, beads, or the like for recombination with the overheads fraction to form a slurry. Examples of useful hydrocarbon mixtures include crude oil, shale oil, hydrotreated shale oil, fuel oil, gas oil, like hydrocarbon mixtures and mixtures of two or more of the same type or different hydrocarbon mixtures. Crude oils are particularly useful with this invention and especially those classified as "waxy" crude oils. Examples of the latter include crude oils which exhibit a "waxy gell" appearance at seasonably ambient temperatures and which contain about 1% to about 80% wax, more preferably about 10% to about 80%, (wax is defined as the precipitate which forms after one part of crude oil is dissolved in 10 parts of methyl ethyl ketone at about 80° C. and the mixture is chilled to −25° C.) and preferably those which have an average pour point above the average minimum temperature of the transporting system, e.g., a pipeline. Examples of average pour points of crude oils particularly useful with this invention include about −23.3° C. to about 200° F. and preferably about 17.8° C. to about 150° F.

The hydrocarbon mixtures are commonly distilled to form a relatively low pour point overheads fraction and a relatively high pour point bottoms fraction or "resid." The optimum distillation cutpoint may be obtained, for example, according to the principles of U.S. Pat. No.

4,149,756. At least a portion of the relatively high pour point bottoms fraction is congealed and comminuted to form substantially solid particles having an average diameter of about 0.05 mm to about 20 mm or more, such as under conditions disclosed in U.S. Pat. Nos. 3,804,752, 3,846,279 or the like. A slurry system is then formed by adding at least a portion of the congealed, solid particles to a carrier fluid comprising at least a portion of the relatively low pour point overheads fraction. The carrier fluid may additionally comprise additives, diluents and the like, as required for optimization of a particular slurry system. The slurry system may also be formed under conditions such as those disclosed in U.S. Pat. No. 3,910,299. It has been found that the pressure drop experienced by transporting the slurry system through a pipeline is substantially less than that of the original hydrocarbon mixture, and that such slurry systems are capable of facilitating transportation of hydrocarbon mixtures which are too viscous to be economically conventionally transported through a pipeline at seasonally ambient temperatures.

It has been determined that in order to maximize the efficiency of a hydrocarbon slurry system, i.e., slurry pumpability, it is highly desirable to optimize the pressure drop based upon the operating parameters of the transportation system, e.g. a pipeline system. The pressure drop experienced by a hydrocarbon slurry is highly dependent upon the wax crystal content of the slurry system. Thus, according to the present invention, it is possible to measure the wax crystal content of a slurry system, correlate the wax crystal content to the expected pressure drop that the slurry system will experience when transported through a particular pipeline, and make modifications or adjustments to the slurry composition, if necessary, all prior to stabilization of the slurry system and prior to transporting the slurry system in a particular pipeline.

Initially, the pressure drop experienced by transporting a slurry system through a pipeline is only slightly higher than the pressure drop obtained by transporting the overheads fraction alone. However, with time and mixing, the congealed particles in the slurry system tend to disintegrate releasing wax crystals into suspension in the carrier fluid or relatively high pour point overheads fraction of the slurry system. After a period of time, the slurry system stabilizes, an equilibrium of slurry properties is obtained, and the pressure drop experienced by transporting the slurry system through a pipeline is primarily a function of slurry solids type and content.

The wax crystal content of a stabilized slurry system at a predetermined seasonally ambient temperature level may be determined by measuring the wax crystal content of the congealed particles of the relatively high pour point bottoms fraction, e.g. by nuclear magnetic resonance and/or differential scanning calorimetry techniques, and then multiplying this value by the percentage of the relatively high pour point fraction which is added to the overheads fraction to form the slurry system. Once the wax crystal content of the slurry system has been determined, the pressure drop expected to be experienced by transporting the stabilized slurry system through a particular pipeline at the seasonally ambient temperature is determined by the relationship:

$$\Delta P = ae^{bX}$$

where "ΔP" is the expected pressure drop in pounds per square inch per unit of distance, "a" and "b" are constants for the particular pipeline relating to the size of the pipeline and the flow rate of the slurry, and to the hydrodynamic volume of the wax crystals, respectively, and "X" is the percentage of wax crystals by weight in the slurry system from the congealed particles of the relatively high pour point bottoms fraction. The constants "a" and "b" are determined empirically through analysis of data relating to the particular pipeline. More specifically, the constants "a" and "b" are determined by forming a graph of the natural logarithm of the pressure drop data actually experienced by pumping a slurry through a particular pipeline at a given temperature as a function of the wax crystal content of the slurry system, and then determining "a" and "b" as the pressure drop at zero percent wax crystal content and the slope, respectively, of the resulting data line.

If the expected pressure drop determined according to the foregoing relationship exceeds that which is optimum or desirable for the pipeline transportation system, the composition of the slurry system is modified or adjusted to obtain optimum or desirable pressure drop levels prior to slurry stabilization and prior to transporting the slurry system through the pipeline. Thus, according to the present invention, the composition of a slurry system is modified, if necessary, to obtain optimum or desirable pressure drop levels prior to injecting the original slurry system into the pipeline and actually experiencing transportation problems with the slurry system, such as excessive pressure drop.

Suitable modifications to the slurry system include, but are not limited to, modifying the percentage of relatively high pour point bottoms fraction in the slurry system, adding one or more diluents and/or additives to the relatively low pour point overheads fraction of the slurry system, and the like. For example, additives such as surfactants, dispersing agents, agents to improve the fluidity of the resulting mixture, etc. or diluents such as low viscosity hydrocarbon miscible materials, carbon dioxide, crude oils, straight run gasoline, natural gas, methane, propane, etc., can be added if necessary.

It has further been found that if the overheads fraction has not been properly cut, the true pressure drop experienced by the slurry system may exceed that determined according to the foregoing relationship due to inclusion of heavier fractions and subsequent wax crystal formation in the overheads. Wax crystals formed in the overheads fraction have a threshold limit based on their size, type and content. When this threshold is exceeded, the pressure drop along the pipeline increases greatly. The formation of wax crystals in the overheads fraction appears to have a significantly greater effect on pressure drop than a corresponding amount of wax crystals formed in the bottoms fraction. The expected pressure drop caused both by a distillation cut with too much heavy materials in the overheads fraction may be determined by modifying the foregoing relationship as follows:

$$\Delta P = ae^{b(X+Xe)}$$

where "Xe" is the amount of "effective crystals" in the overheads fraction which would exhibit an equivalent effect on pressure drop as if the wax crystals were formed in the congealed particles of the bottoms fraction.

It has further been found that if a significant amount of water is present in the congealed particles of the bottoms fraction or elsewhere in the slurry system, the true pressure drop experienced by the slurry system may also exceed that expected in a properly cut slurry system. The expected effect of water in the slurry system may be determined by modifying the relationship as follows:

$$\Delta P = ae^{b(X+0.48Y)}$$

where "Y" is the percentage of water in the slurry system.

EXAMPLE 1

Slurry systems comprising a relatively low pour point overheads fraction from a hydrocarbon mixture distillation process and congealed particles obtained from the relatively high pour point bottoms fraction of the distillation process are pumped through a 2 inch pipeline at temperatures ranging from about 38° F. to about 60° F. The wax crystal content of the congealed particles is varied to obtain data on the dependence of experienced pressure drop on wax crystal content for the pipeline. From the resulting data, the constants "a" and "b" for the pipeline at various flow rates are determined to be as follows:

TABLE 1

| Flow Rate (ft./sec.) | a (psi/mile) | b |
|---|---|---|
| 3.5 | 5.47 | 0.194 |
| 2.0 | 4.50 | 0.194 |

A waxy crude oil from the Altamont Field in Utah's Uinta Basin has an average API gravity of about 40° and an average pour point of about 110° F. This crude oil is distilled such that about 31% by weight of the crude is taken as an overheads fraction (i.e. low pour point fraction). The final overheads temperature on the distillation column is 266° F. and the final temperature of the bottoms fraction (i.e. high pour point fraction) is 581° F. The pour point of the bottoms fraction is 118° F. The bottoms fraction is prilled by spraying it at a temperature of 160° F. into the atmosphere (air at 80° F.) through a 0.014 inch circular nozzle at a rate of about 0.3 gallons/hour. Nozzle temperature is maintained at about 118° F. to about 127° F. As the liquid leaves the nozzle, it is solidified into prills upon contact with the air. The wax crystal content of the prills at temperatures of 38° F., 50° F. and 60° F. is measured using pulsed nuclear magnetic resonance techniques.

Slurry samples are prepared by adding varying quantities of the prills into fixed quantities of the overheads fraction at temperatures of 38° F., 50° F. and 60° F. The expected pressure drop in the 2 inch pipeline is determined for each sample. The samples are then transported through the 2 inch pipeline and the actual pressure drop experienced by each slurry sample is measured. The expected and actual pressure drops of the slurry samples is compared in Table 2:

TABLE 2

| T (°F.) | % Prills (by weight) | % Wax Crystals (by weight) | Actual Δ P (psi/mile) | Expected Δ P (psi/mile) |
|---|---|---|---|---|
| 38° | 27.5 | 16.4 | 139 | 132 |
| 38° | 30.0 | 17.9 | 177 | 176 |
| 38° | 32.5 | 19.4 | 229 | 236 |
| 38° | 35.0 | 20.9 | 310 | 315 |
| 38° | 37.5 | 22.4 | 451 | 422 |
| 38° | 40.0 | 23.9 | 539 | 564 |
| 50° | 37.5 | 21.3 | 340 | 341 |

TABLE 2-continued

| T (°F.) | % Prills (by weight) | % Wax Crystals (by weight) | Actual Δ P (psi/mile) | Expected Δ P (psi/mile) |
|---|---|---|---|---|
| 50° | 40.0 | 22.7 | 440 | 447 |
| 50° | 42.5 | 24.1 | 590 | 587 |
| 60° | 42.5 | 22.0 | 395 | 390 |
| 60° | 45.0 | 23.3 | 505 | 502 |
| 60° | 47.5 | 24.6 | 680 | 647 |

EXAMPLE 2

The procedure of Example 1 is repeated using a 0.5 inch pipeline. The following values for "a" and "b" are obtained:

TABLE 3

| Flow Rate (ml./min.) | a (psi/10 ft.) | b |
|---|---|---|
| 15.4 | .062 | 0.197 |

The inventive concepts have been described herein in connection with the foregoing presently preferred, illustrative embodiments. Various modifications may be apparent from this description. Any such modifications are intended to fall within the scope of the appended claims except insofar as precluded by the prior art.

What is claimed is:

1. In a method of transporting a slurry through a pipeline wherein a hydrocarbon mixture is distilled in a distillation process and an overheads fraction from said process is used as a carrier fluid for congealed particles of a bottoms fraction from said process to form said slurry, the improvement for controlling the expected pressure drop of a slurry prior to introducing the slurry into the pipeline comprising:

(a) measuring a wax crystal content of the congealed particles of the bottoms fraction of the distillation process;

(b) determining the wax crystal content from the congealed particles in a slurry formed by adding a known amount of congealed particles of the bottoms fraction to a known amount of the overheads fraction;

(c) determining the expected pressure drop of the slurry in a particular pipeline according to the relationship:

$$P = ae^{bX}$$

where "P" is the expected pressure drop of the slurry in a particular pipeline in pounds per square inch, "a" and "b" are constants for the pipeline relating to the size of the pipeline and the expected flow rate of the slurry through the pipeline, and to the hydrodynamic volume of the wax crystals, respectively, "e" is the natural logarithm base constant, and "X" is the percentage of wax crystals by weight in the slurry from the congealed particles; and (d) modifying the composition of the slurry to obtain a modified slurry having an optimum or desireable expected pressure drop prior to introducing the slurry into the pipeline.

2. The method of claim 1 wherein the wax crystal content of the congealed particles is determined by nuclear magnetic resonance techniques.

3. The method of claim 1 wherein the wax crystal content of the congealed particles is determined by differential scanning calorimetry techniques.

4. The method of claim 1 wherein the carrier fluid comprises a sufficient amount of wax crystals formed in the overheads fraction to exhibit a substantial effect upon the expected pressure drop of the slurry, and wherein the expected efficiency of the slurry is determined according to the relationship:

$$\Delta P = ae^{b(X+Xe)}$$

wherein "Xe" is the amount of wax crystals in the overheads fraction which would exhibit an equivalent effect on pressure drop as the wax crystals formed in the congealed particles.

5. The method of claim 1 wherein the slurry comprises a sufficient amount of water to exhibit a substantial effect on the expected pressure drop of the slurry, and wherein the expected pressure drop of the slurry is determined according to the relationship:

$$\Delta P = ae^{b(X+0.48Y)}$$

wherein "Y" is the percentage of water in the slurry system.

6. The method of claim 1 wherein the composition of the slurry is modified by changing the percentage of the congealed particles in the slurry.

7. The method of claim 1 wherein the composition of the slurry is modified by adding one or more diluents to the carrier fluid of the slurry.

8. The method of claim 1 wherein the composition of the slurry is modified by adding one or more additives to the carrier fluid of the slurry.

* * * * *

UNITED STATES PATENT AND TRADEMARK OFFICE

CERTIFICATE OF CORRECTION

PATENT NO. : 4,310,011

DATED : January 12, 1982

INVENTOR(S) : James E. Tackett, Jr.

It is certified that error appears in the above-identified patent and that said Letters Patent are hereby corrected as shown below:

Col. 1, lines 31-32: Delete "15°C. to about 122°C." and insert --15°C. to about -12.2°C.--;line 40: Delete "12.2°C. blow" and insert --12.2°C. below--. Col. 2, line 51: Delete "gell" and insert --gel--; line 62: Delete "200°F." and insert --93.3°C.--; delete "17.8°C." and insert -- -17.8°C.--; line 63: Delete "150°F." and insert --65.6°C.--. Col. 4, line 11: Following "slurry" insert --system--; line 55: Delete "materials" and insert --material--. Col. 5, line 17: Delete "2 inch" and insert --5.08 centimeter--; line 18: Delete "38°F. to about 60°F." and insert --3.3°C. to about 15.6°C.--; line 34: Delete "110°F." and insert --43.3°C.--; line 38: Delete "266°F." and insert --130°C.--; line 40: Delete "581°F." and insert 305°C.--; delete "118°F." and insert --47.8°C.--; line 42: Delete "160°F." and insert --71.1°C.--; delete "80°F." and insert --26.7°C.--; line 43: Delete "0.014 inch" and insert --0.356 millimeter--; line 44: Delete "0.3 gallons" and insert --1.14 liters--; line 45: Delete "118°F. to about 127°F." and insert --47.8°C. to about 52.8°C--; lines 48 & 52: Delete "38°F., 50°F. and 60°F." and insert --3.3°C., 10°C. and 15.6°C.-- at both occurrences; lines 53 & 55: Delete "2 inch" and insert --5.08 centimeter-- at both occurrences; line 58: Delete "is" and insert --are--. Col. 6, lines 14 & 15: Delete "0.5 inch" and insert --1.27 centimeter--.

Signed and Sealed this

*First* Day of *June 1982*

[SEAL]

*Attest:*

GERALD J. MOSSINGHOFF

*Attesting Officer* *Commissioner of Patents and Trademarks*